US011021939B2

(12) United States Patent
Crowley et al.

(10) Patent No.: US 11,021,939 B2
(45) Date of Patent: Jun. 1, 2021

(54) SYSTEM AND METHOD RELATED TO PUMPING FLUID IN A BOREHOLE

(71) Applicant: SCHLUMBERGER TECHNOLOGY CORPORATION, Sugar Land, TX (US)

(72) Inventors: Matthew Crowley, Katy, TX (US); David Bauchelle, Houston, TX (US); James Rudolph Wetzel, Rosharon, TX (US); Neil Griffiths, Cambridge (GB); Nils Van Der Stad, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 158 days.

(21) Appl. No.: 16/061,206

(22) PCT Filed: Nov. 18, 2016

(86) PCT No.: PCT/US2016/062637

§ 371 (c)(1),
(2) Date: Jun. 11, 2018

(87) PCT Pub. No.: WO2017/099968

PCT Pub. Date: Jun. 15, 2017

(65) Prior Publication Data

US 2018/0363431 A1 Dec. 20, 2018

Related U.S. Application Data

(60) Provisional application No. 62/266,226, filed on Dec. 11, 2015.

(51) Int. Cl.
*E21B 43/12* (2006.01)
*E21B 17/02* (2006.01)
(Continued)

(52) U.S. Cl.
CPC ..... *E21B 43/128* (2013.01); *E21B 17/028* (2013.01); *F04B 47/06* (2013.01); *F04D 13/10* (2013.01)

(58) Field of Classification Search
CPC ..... E21B 43/128; E21B 43/13; E21B 17/028; E21B 17/0283; E21B 17/0285
See application file for complete search history.

(56) References Cited

U.S. PATENT DOCUMENTS 6,585,049 B2 7/2003 Leniek, Sr.
7,533,461 B2 5/2009 Griffiths
(Continued)

FOREIGN PATENT DOCUMENTS

WO 2015173328 A1 11/2015

OTHER PUBLICATIONS

International Search Report and Written Opinion issued in the PCT Application PCT/US2016/062637, dated Feb. 23, 2017 (15 pages).
(Continued)

*Primary Examiner* — Shane Bomar

(57) ABSTRACT

A technique facilitates use of a submersible pumping system deployed downhole in a borehole. A docking assembly comprises a docking station which has at least one electrical wet connector and is coupled to a receiving tubular. An electrical power cable is coupled to the docking station to enable electrical power to be provided to the at least one electrical wet connector. The docking assembly is deployed downhole to a desired location in the borehole to enable coupling with the submersible pumping system. The submersible pumping system is simply moved downhole into the receiving tubular and into electrical engagement with the electrical wet connectors.

19 Claims, 6 Drawing Sheets

(51) Int. Cl.
*F04D 13/10* (2006.01)
*F04B 47/06* (2006.01)

(56) References Cited

U.S. PATENT DOCUMENTS 8,087,461 B2 1/2012 Fitzgerald
8,257,103 B2 9/2012 Costa et al.
8,353,336 B2 1/2013 Neuhaus et al.
8,408,312 B2 4/2013 Fielder et al.
8,443,900 B2 5/2013 Fielder et al.
8,534,366 B2 9/2013 Fielder et al.
8,665,110 B2 3/2014 Coenen et al.
8,833,441 B2 9/2014 Fielder et al.
9,080,412 B2 7/2015 Wetzel et al.
9,151,131 B2 10/2015 Drablier et al.
9,291,026 B2 3/2016 Wetzel et al.
2002/0050361 A1* 5/2002 Shaw ..... E21B 43/128 166/380
2003/0085815 A1* 5/2003 Tilton ..... E21B 34/066 340/854.4
2006/0243450 A1* 11/2006 Head ..... E21B 17/028 166/369
2009/0242212 A1* 10/2009 Shaw ..... E21B 43/128 166/378
2010/0183455 A1 7/2010 Liberg
2011/0030972 A1* 2/2011 Brookbank ..... E21B 17/028 166/381
2011/0311375 A1* 12/2011 Tetzlaff ..... F04B 47/06 417/63
2012/0118563 A1* 5/2012 Tetzlaff ..... E21B 17/028 166/242.6
2013/0043019 A1* 2/2013 Hansen ..... E21B 43/128 166/65.1
2013/0062050 A1* 3/2013 Head ..... E21B 43/128 166/105
2013/0098632 A1* 4/2013 Wetzel ..... E21B 19/16 166/373
2013/0341033 A1 12/2013 Carstensen et al.
2014/0020907 A1* 1/2014 Head ..... E21B 43/128 166/377
2014/0102721 A1 4/2014 Bespalov et al.
2014/0242825 A1 8/2014 Watson et al.
2016/0168937 A1* 6/2016 Hess ..... E21B 17/028 166/369
2017/0081925 A1* 3/2017 Brown ..... H01B 7/18
2017/0247954 A1* 8/2017 Bencze ..... E21B 17/028

OTHER PUBLICATIONS

International Preliminary Report on Patentability issued in the PCT Application PCT/US2016/062637, dated Jun. 12, 2018 (11 pages).

* cited by examiner

SYSTEM AND METHOD RELATED TO PUMPING FLUID IN A BOREHOLE

CROSS-REFERENCE TO RELATED APPLICATION

The present document is based on and claims priority to U.S. Provisional Application Ser. No. 62/266,226, filed Dec. 11, 2015, which is incorporated herein by reference in its entirety.

BACKGROUND

Hydrocarbon fluids such as oil and natural gas may be obtained from a subterranean geologic formation, referred to as a reservoir, by drilling a well that penetrates the hydrocarbon-bearing geologic formation. After a wellbore is drilled, various forms of well completion components may be installed to enable control over and to enhance efficiency of producing fluids from the reservoir. In some applications, an electric submersible pumping system is deployed downhole into the wellbore and operated to produce well fluids. The electric submersible pumping system comprises a submersible pump powered by a submersible motor. Electric power is provided to the submersible motor via a power cable connected to the submersible motor and deployed downhole with the electric submersible pumping system.

SUMMARY

In general, a system and methodology facilitate use of a submersible pumping system, e.g. an electric submersible pumping system, deployed downhole in a borehole. A docking assembly comprises a docking station which has at least one electrical wet connector and is coupled to a receiving tubular. An electrical power cable is coupled to the docking station to enable electric power to be provided to the at least one electrical wet connector. The docking assembly is deployed downhole to a desired location in the borehole to enable coupling with the submersible pumping system simply by moving the submersible pumping system downhole into the receiving tubular and into electrical engagement with the electrical wet connectors.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
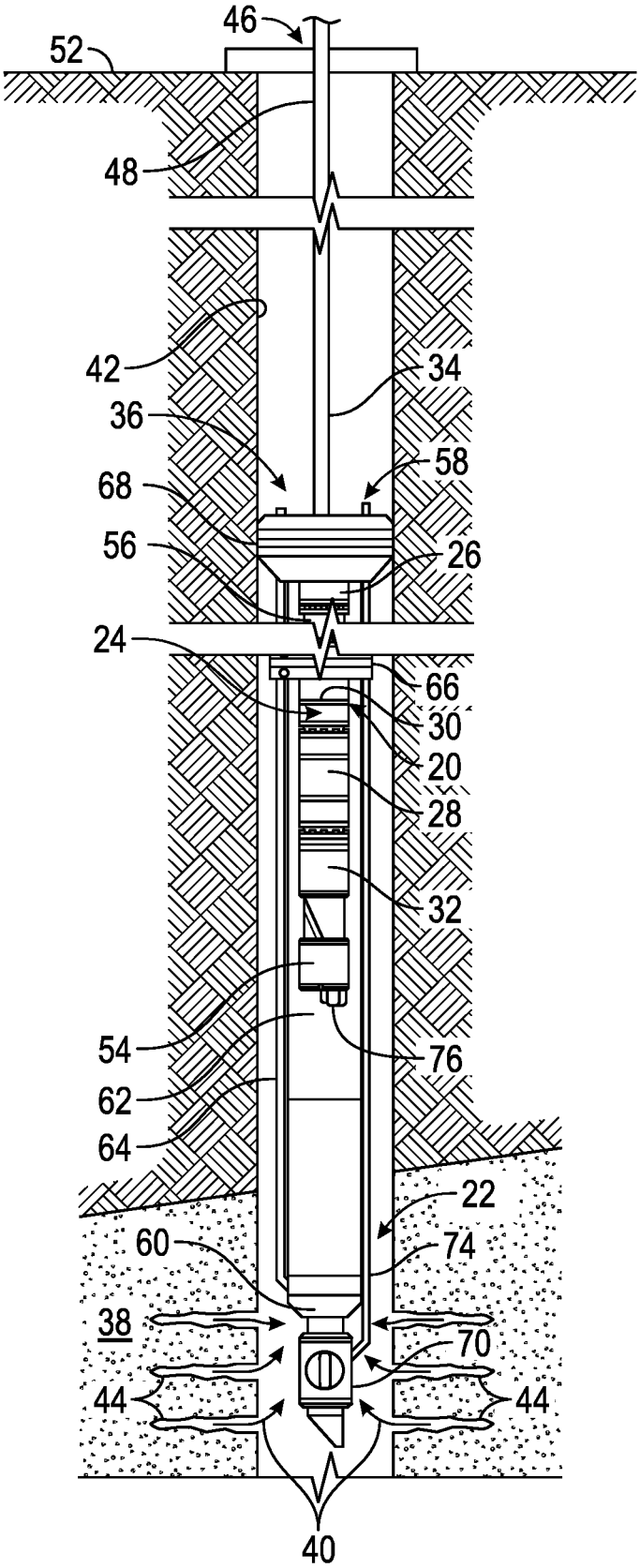
FIG. 1 is an illustration of an example of a submersible pumping system being deployed downhole into a borehole, e.g. a wellbore, for mechanical and electrical coupling with a docking assembly.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which may be used to facilitate deployment and operation of a submersible pumping system in a borehole, e.g. a wellbore. For example, the system and methodology may be used in well applications to facilitate operation of electric submersible pumping systems. According to an embodiment, a docking assembly is constructed to be electrically powered via a power cable when deployed downhole into the borehole. The docking assembly enables easy engagement with the submersible pumping system at a downhole location.

According to an embodiment, the docking assembly comprises a docking station which has at least one electrical wet connector, e.g. a plurality of electrical wet connectors. The docking station also is coupled to a receiving tubular. An electrical power cable is coupled to the docking station to enable electrical power to be provided to the electrical wet connector(s). The docking assembly is deployed downhole to a desired location in the borehole to enable coupling with the submersible pumping system. For example, the docking assembly may be positioned downhole and subsequently the submersible pumping system is moved into engagement with the docking assembly. During coupling, the submersible pumping system may be moved downhole, through the receiving tubular, into the docking station, and into electrical connection with the electrical wet connectors.

In some embodiments, the electrical power cable may comprise at least one conductor, e.g. three conductors, individually connected with corresponding electrical wet connector(s) disposed within an interior of the docking station. According to an example, the docking station may comprise a coupling section and the electrical power cable may enter the docking station through the coupling section, e.g. through a seal in the coupling section. Within the docking station, the individual conductors of the power cable are separated (if more than one conductor is contained in the power cable) so that each conductor may be coupled into electric communication with its corresponding electrical wet connector.

The submersible pumping system may comprise a motor connector having a corresponding number of electrical connector(s) constructed for engagement with and electrical connection to corresponding electrical wet connector(s). By way of example, the motor connector may be positioned at a lower end of a submersible motor. Orienting features may be used to guide the electrical connectors into engagement with the corresponding electrical wet connectors as the submersible pumping system is deployed down into the docking assembly.

In a specific example, the orientation features may comprise a feature disposed on a lower end of the motor connector for engagement with an orienting feature of the docking assembly. However, the orientation features may be positioned at other locations along the motor connector/submersible pumping system. The orientation features cause rotation of the motor connector (and the submersible pumping system) about its axis as it is lowered into the docking assembly. For example, the orienting features of the motor connector and the docking assembly may be used in cooperation to align the electrical connectors of the submersible pumping system with the electrical wet connectors of the docking assembly to form the desired electrical connection.

The docking assembly enables electrical power to be provided downhole to the downhole docking assembly independently of the submersible pumping system. The submersible pumping system, e.g. electric submersible pumping system, may then simply be deployed downhole and placed into electrical communication with the power cable via docking at the downhole docking assembly. Consequently, the submersible pumping system may be deployed, serviced, and/or replaced without routing a dedicated power cable downhole with the submersible pumping system.

Referring generally to FIG. 1, an embodiment of a submersible pumping system 20 is illustrated as being deployed downhole into a well 22 for mechanical and electrical coupling with a docking assembly as discussed in greater detail below. By way of example, the submersible pumping system 20 may comprise or be in the form of an electric submersible pumping system 24. Additionally, the submersible pumping system 20 may comprise a variety of components depending on the particular application or environment in which it is used.

In the illustrated example, the electric submersible pumping system 24 comprises a submersible pump 26, a submersible electric motor 28, and a motor protector 30. The submersible pump 26 is operatively coupled with the submersible motor 28 by, for example, a driveshaft. Depending on the operation, electric submersible pumping system 24 may comprise other components such as a gauge section 32 and an expansion joint 34. In some embodiments, submersible pump 26 may be a centrifugal pump having two or more stages, e.g. compression stages, with impellers rotated by submersible motor 28. The net thrust load, e.g. down thrust load, resulting from operation of submersible pump 26 may be resisted by, for example, a thrust bearing positioned at a desirable location along motor protector 30.

Well 22 may comprise a borehole 36, e.g. a wellbore, drilled into a geologic formation 38 containing a desirable production fluid 40, e.g. petroleum. The borehole 26 may be lined with a tubular well casing 42, and perforations 44 may be formed through the well casing 42 to enable flow of fluids between the surrounding formation 38 and the wellbore 36. The electric submersible pumping system 24 may be deployed downhole into borehole 36 via a conveyance system 46 and into engagement with a docking assembly as described in greater detail below. By way of example, the conveyance system 46 may comprise tubing 48, such as coiled tubing, connected to submersible pump 26 by a suitable connector sub. However, the conveyance system 46 also may comprise wireline, slick line, or other suitable conveyance systems able to convey the submersible pumping system 20 downhole from a surface location 52.

During operation, electrical power is supplied to submersible motor 28 via a motor connector 54 as explained in greater detail below. The submersible motor 28 is powered to, in turn, power submersible pump 26 via a suitable driveshaft. Operation of submersible pump 26 causes fluid 40 in borehole 36 to be drawn into the submersible pumping system 20 through a pump intake 56. The fluid 40 is pumped upwardly to a surface collection location or to another suitable collection location. In the illustrated embodiment, for example, the fluid 40 may be pumped upwardly through an interior of tubing 48 to a desired collection location at surface 52.

Figure 2:
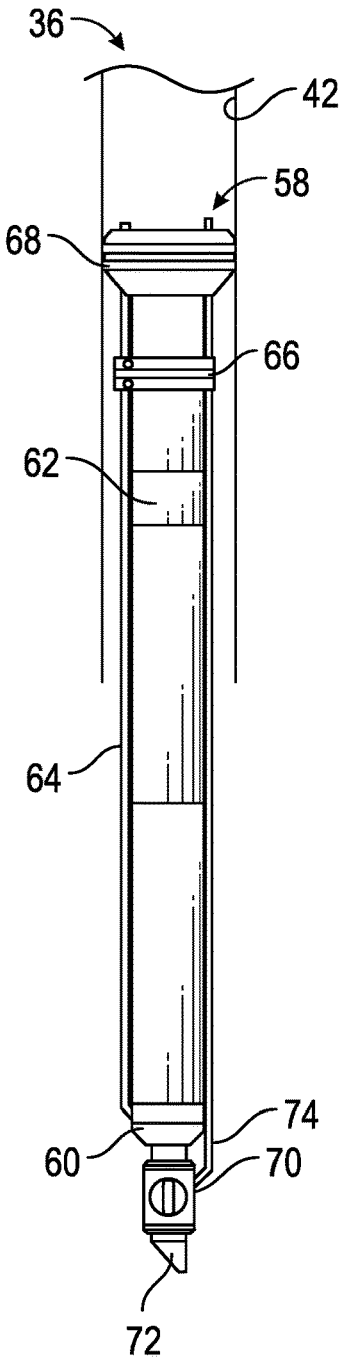
FIG. 2 is an illustration of an example of a docking assembly which may be positioned in the borehole to receive a submersible pumping system, according to an embodiment of the disclosure.

With reference to FIGS. 1 and 2, an embodiment of a docking assembly 58 is illustrated for use in cooperation with the submersible pumping system 20. For example, the docking assembly 58 may be constructed to receive electric submersible pumping system 24 and to provide power to electric submersible pumping system 24 via motor connector 54. In this example, the docking assembly 58 comprises a docking station 60 internally configured for receipt and electrical connection with motor connector 54. Motor connector 54 may be coupled to submersible motor 28 via a suitable internal conductor or conductors, e.g. three internal wire conductors, to provide power thereto. The docking assembly further comprises a receiving tubular 62 which is coupled to the docking station 60 and sized to receive the submersible pumping system 20, e.g. electric submersible pumping system 24. The receiving tubular 62 may comprise a single tubular or a plurality of aligned tubulars having internal diameters sufficiently large to receive the electric submersible pumping system 24 as the motor connector 54 is moved down into electrical engagement with the docking station 60 (see FIG. 6).

Electric power is provided to docking station 60 via an electrical power cable 64. Electrical power cable 64 may be routed from a surface power source or other suitable power source and deployed downhole with or as part of docking assembly 58. In the illustrated example, the power cable 64 is routed down along the exterior of receiving tubular 62 and into docking station 60. A cable clamp or clamps 66 may be used to secure the power cable 64 along receiving tubular 62.

In some embodiments, the docking assembly 58 may comprise other components, such as a docking station seal assembly 68 constructed to seal against a surrounding surface, e.g. against casing 42. In some applications, the seal assembly 68 may be in the form of a packer selectively expandable against the surrounding casing 42. In the illustrated example, the docking station seal assembly 68 is connected to receiving tubular 62.

The docking assembly 58 also may comprise other components, such as a valve 70 coupled between a fluid intake 72 and the docking station 60. Fluid intake 72 allows fluid from the borehole 36 to enter into the interior of docking assembly 58 for pumping by, for example, the electric submersible pumping system 24 located inside. The valve 70 may be provided to enable selective closure of this flow path into docking assembly 58. In some embodiments, valve 70 may be controlled via a control line 74, e.g. a hydraulic control line, pneumatic control line or electrical control, selected according to the valve type.

Figure 3:
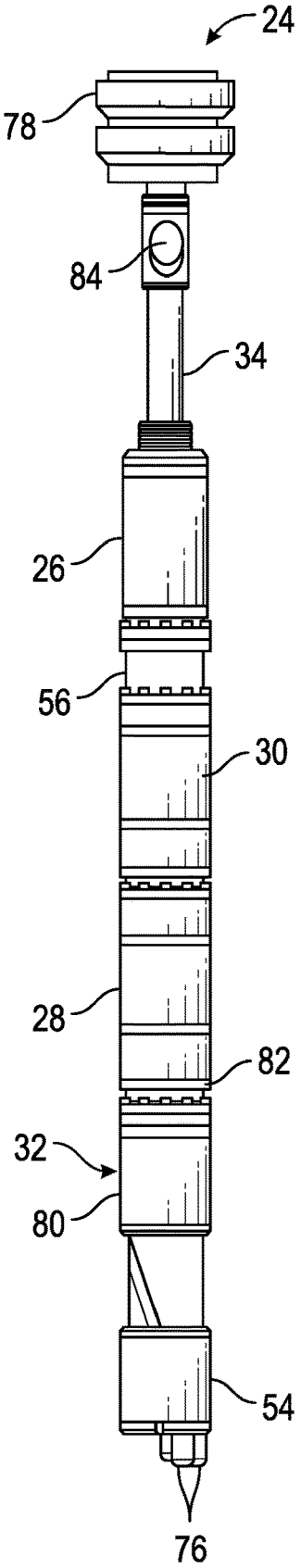
FIG. 3 is an illustration of an example of a submersible pumping system in the form of an electric submersible pumping system with a motor connector and electrical connectors oriented for engagement with a docking station of the docking assembly, according to an embodiment of the disclosure.

With additional reference to FIG. 3, an embodiment of the electric submersible pumping system 24 is further illustrated. The electric submersible pumping system 24 is sized for receipt in docking assembly 58 and comprises submersible pump 26, submersible motor 28, motor protector 30, and motor connector 54 as illustrated in FIG. 1. The motor connector 54 comprises at least one electrical connector 76, e.g. a plurality of electrical connectors 76, positioned for engagement with at least one corresponding electrical wet connector, e.g. a plurality of corresponding electrical wet connectors, in docking station 60. In some embodiments, submersible motor 28 is powered by three-phase electrical power and three electrical connectors 76 are conductively coupled with motor 28 via suitable internal conductors for supplying the three-phase power to submersible motor 28. The motor connector 54 may be positioned at a lower end of the electric submersible pumping system 24 to facilitate engagement with docking station 60. Once the motor connector 54 is electrically engaged with docking station 60, electrical power can be provided to submersible motor 28 via electricity supplied to docking station 60 by power cable 64.

Depending on the application, the electric submersible pumping system 24 may comprise other components, such as a pumping system seal assembly 78. The pumping system seal assembly 78 is positioned for sealing engagement with the interior of receiving tubular 62 when the electric submersible pumping system 24 is deployed down into docking assembly 58. The electric submersible pumping system 24 may comprise other components, such as gauge section 32 having sensors 80. The electric submersible pumping system 24 also may comprise other features such as expansion joint 34, a swivel 82, a bypass valve 84, and/or other components to facilitate a given operation. The swivel 82 may be used for aiding alignment of motor connector 54 with docking station 60 without turning the entire electric submersible pumping system 24 or the entire well string. The swivel 82 may be located at a variety of locations along the electric submersible pumping system 24. For example, the swivel 82 may be located immediately above motor connector 54 so that the motor connector 54 is able to rotate without rotating the entire electric submersible pumping system 24.

Figure 4:
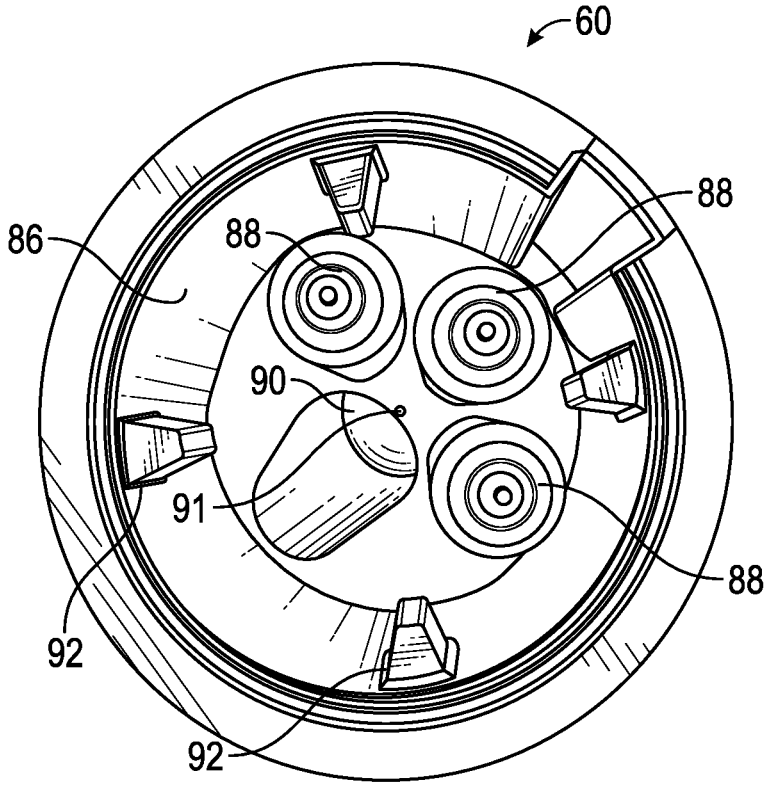
FIG. 4 is a top view of an embodiment of the docking station illustrating examples of electrical wet connectors, according to an embodiment of the disclosure.
Figure 5:
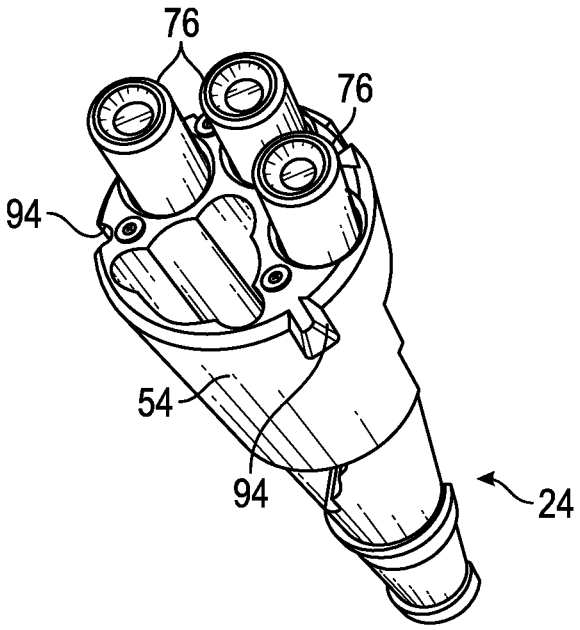
FIG. 5 is an orthogonal view of an example of a motor connector mounted into the submersible pumping system and including electrical connectors oriented for engagement with electrical wet connectors of the docking station, according to an embodiment of the disclosure.

Referring generally to FIG. 4, a view of an interior 86 of docking station 60 is provided. In this example of docking station 60, the interior 86 is sized and shaped to receive motor connector 54 (see FIG. 5). Within interior 86, the docking station 60 comprises at least one electrical wet connector 88, e.g. a plurality of electrical wet connectors 88. In some applications, three electrical wet connectors 88 are provided to enable supply of three-phase power for submersible motor 28. The electrical wet connectors 88 may be positioned to receive the corresponding electrical connectors 76 of motor connector 54 in, for example, a male-female engagement. It should be noted various types of structures may be used for the electrical wet connector(s) 88. In some embodiments, a single wet connector structure 88 may include a plurality of conductors, e.g. three conductors for providing three-phase power. In other embodiments, an individual electrical wet connector 88 may be used for each conductor.

The docking station 60 also comprises a fluid flow passage 90, e.g. a throughbore. Fluid entering through intake 72 is able to pass through fluid flow passage 90 and into interior 86 of the docking station 60. As fluid fills the interior of the docking assembly 58, the electric submersible pump 24 may be operated to pump the fluid to a desired location. To facilitate space efficiency and engagement of the motor connector 54 with docking station 60, the fluid flow passage 90 and wet connector(s) 88 may be eccentrically positioned with respect to a central longitudinal axis 91 of the docking station 60. In other words, the fluid flow passage 90 is radially offset from the central longitudinal axis 91 and the wet connectors 88 are not equally spaced along an entire circle concentric with the central longitudinal axis 91. The fluid flow passage 90 and the wet connector(s) 88 may be located in various off-axis positions. By way of example, the fluid flow passage 90 and the wet connector(s) 88 may be completely or substantially in opposed semicircular regions of a cross-section taken through the central longitudinal axis 91 of the docking station 60. In some embodiments, wet connectors 88 may be equally spaced from each other while being eccentrically positioned with respect to the central longitudinal axis 91. The corresponding fluid flow passage 90 and electrical connectors 76 of motor connector 54 may be comparably arranged to facilitate engagement.

Figure 6:
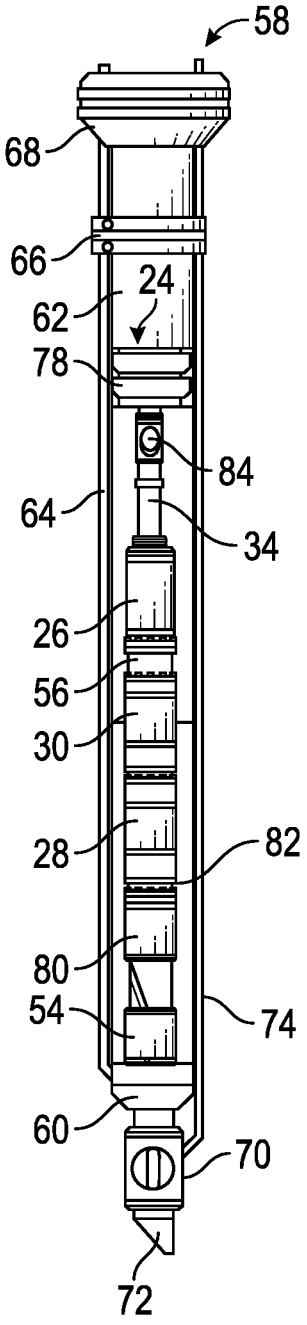
FIG. 6 is an illustration of an example of a submersible pumping system deployed downhole into an interior of the docking assembly and electrically engaged therewith, according to an embodiment of the disclosure.

In some applications, the docking station 60 also may comprise orientation features 92, e.g. an edge or fin, positioned to rotationally secure the motor connector 54. For example, the orientation features 92 may be positioned to engage corresponding orientation features 94 (see FIG. 5) on motor connector 54. In some applications, the orientation features 92, 94 may be used alone or in cooperation with other features to rotate the motor connector 54 and overall electric submersible pumping system 24 for proper alignment of electrical connectors 76 with the corresponding electrical wet connectors 88. As described in greater detail below, the rotational alignment may occur as the motor connector 54 is inserted into electrical engagement with docking station 60, as illustrated in FIG. 6. The electric submersible pumping system 24 may be secured and sealed within receiving tubular 62 via pumping system seal assembly 78. The use of orientation features 92, 94 also facilitates the off-axis positioning of fluid flow passage 90, wet connectors 88, and electrical connectors 76 by ensuring proper alignment of electrical connectors 76 and wet connectors 88 during engagement of motor connector 54 with docking station 60.

Figure 7:
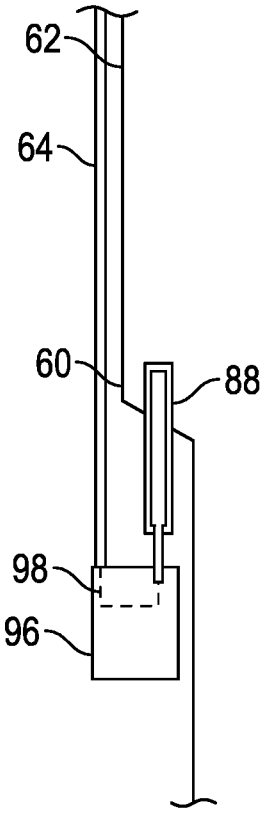
FIG. 7 is a schematic illustration of a connection example between a power cable and electrical wet connector disposed in a docking station of the docking assembly, according to an embodiment of the disclosure.

Referring generally to FIG. 7, a schematic illustration is provided of an embodiment of a connection between power cable 64 and one of the electrical wet connectors 88 disposed in docking station 60. In this example, the power cable 64 is routed along the exterior of the docking station 60 to a coupling section 96 of the docking station 96, e.g. a junction box. In some embodiments, the power cable 64 may be disposed inside of a channel formed along the exterior of docking assembly 58 to shield the power cable 64 from physical impact during insertion into the borehole 36.

Figure 8:
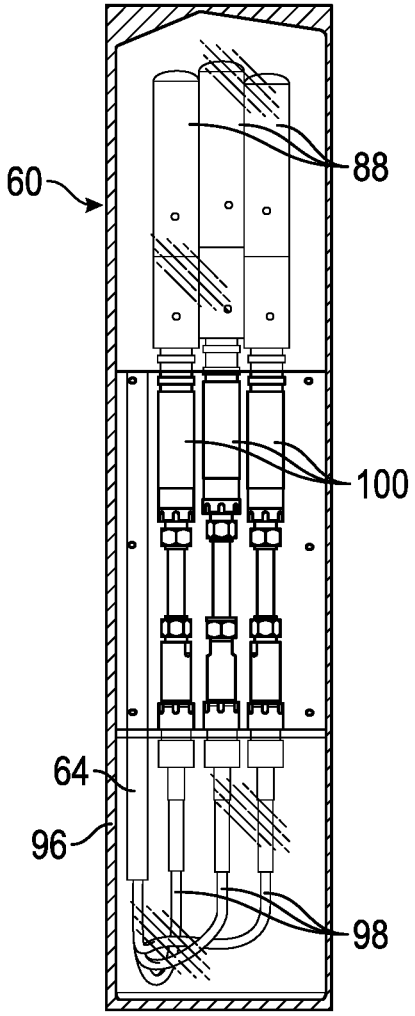
FIG. 8 is an illustration of an example of individual conductors of a power cable coupled with corresponding electrical wet connectors of the docking assembly, according to an embodiment of the disclosure.

Within the coupling section/junction box 96, individual conductors 98 of power cable 64 may be independently coupled with corresponding electrical wet connectors 88, as further illustrated in FIG. 8. In some embodiments, the power cable 64 comprises three conductors 98 for three-phase power. However, other embodiments may use a single conductor 98 or other numbers of conductors 98. In the illustrated embodiment, the three individual conductors 98 may be separated from each other within junction box 96 and placed in electrical communication with corresponding electrical wet connectors 88. In some embodiments, the junction box 96 may be part of docking station 60, e.g. located along or within docking station 60. Additionally, the junction box 96 may have a seal which effectively seals about power cable 64 so as to prevent unwanted entry of well fluids into sealed junction box 96.

According to the embodiment illustrated in FIG. 8, power cable 64 enters junction box 96 and the conductors 98, e.g. three conductors, of the power cable 64 are split into individual conductors and coupled with corresponding individual electrical wet connectors 88. By way of example, the individual conductors 98 of power cable 64 may be separated within junction box 96 and routed through corresponding conduits 100. The conduits 100 extend from the junction box 96 and along the interior of docking station 60 to shield the individual conductors 98 from, for example, well fluid. In this example, the individual conductors 98 are routed through conduits 100 and are electrically connected to the corresponding electrical wet connectors 88, as illustrated.

Figure 9:
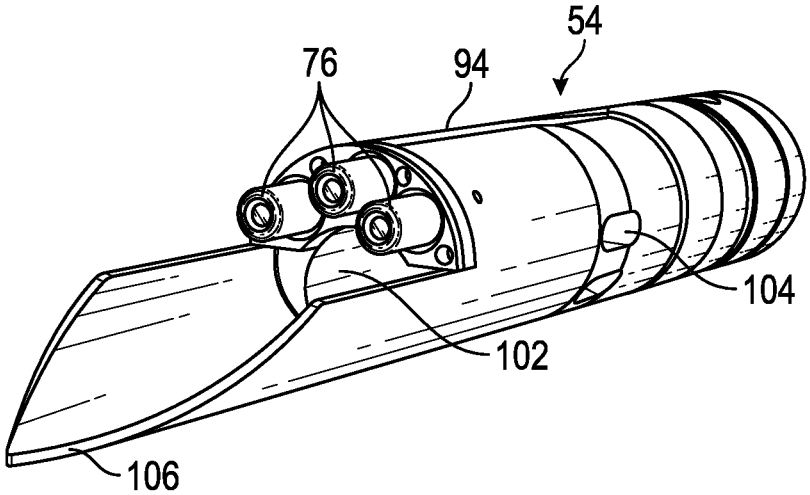
FIG. 9 is an orthogonal view of an example of a motor connector of the submersible pumping system, according to an embodiment of the disclosure.

Referring generally to FIG. 9, an embodiment of motor connector 54 is illustrated. In this embodiment, the motor connector 54 comprises electrical connectors 76, e.g. male electrical connectors. The motor connector 54 also may comprise a fluid passage 102 which receives fluid flow from fluid flow passage 90 and directs the fluid out through at least one discharge port 104. The fluid flows from the discharge port(s) 104 and then along the interior of docking assembly 58 to intake 56 of submersible pump 26.

In the illustrated example, motor connector 54 further comprises orientation feature 94 which may be in the form of a detent for receiving corresponding orientation feature 92, e.g. an orientation tab, when the motor protector 54 is inserted into docking station 60. In some embodiments, motor connector 54 also may comprise a further orientation feature 106 which may be in the form of an orientation fin. For example, the orientation fin 106 may have a generally triangular shape or a generally arched shape. In some embodiments, the orientation fin 106 may have the shape of a tube which has been cut in half lengthwise and whose length has been cut at a non-oblique angle so as to form a single lead point and two surfaces which curve away from the lead point towards the remainder of the motor connector 54. In some embodiments, the orientation fin 106 may be in the form of a hollow semi-cylindrical body having a pointed tip. These are just a few examples of orientation features 106 which may be used in cooperation with docking assembly 58 to rotate the motor connector 54 and overall electric submersible pumping system 24 to the desired rotational position for engagement of electrical connectors 76 with corresponding electrical wet connectors 88.

Figure 10:
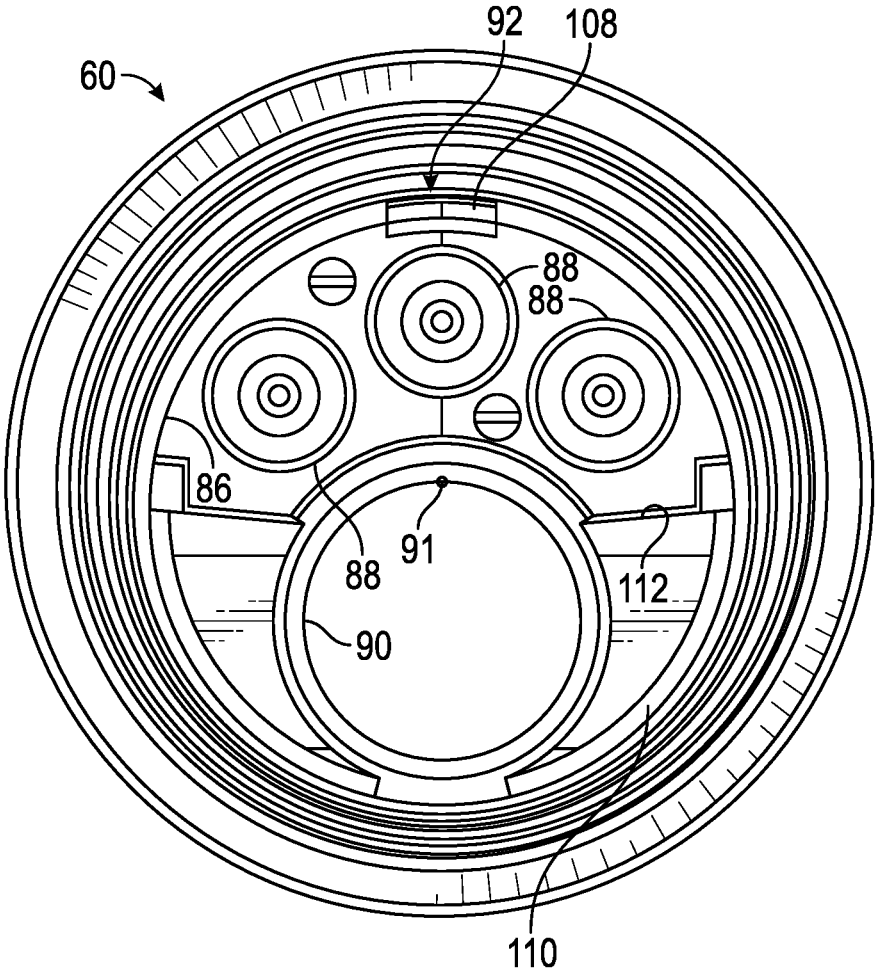
FIG. 10 is a top view of an example of a docking station of the docking assembly, according to an embodiment of the disclosure.

Referring generally to FIG. 10, an embodiment of the docking station 60 is illustrated to show interior region 86. In this example, orientation feature 92 may comprise at least one orientation tab 108 positioned for receipt in orientation feature/detent 94 of motor connector 54. Additionally, the docking station 60 may comprise other internal orientation features, such as an orienting track 110 and an orienting edge 112. By way of example, the orienting track 110 may be positioned to interact with orientation fin 106 of motor connector 54 to rotate the motor connector 54 about its axis during insertion of motor connector 54 into interior region 86. The interaction of orientation fin 106 and orienting track 110 positions electrical connectors 76 for linear engagement with corresponding electrical wet connectors 88.

In some embodiments, the orienting track 110 may have a generally elliptical shape disposed at a non-oblique angle relative to a longitudinal axis of the docking station 60. For example, the orienting track 110 may extend along an elliptical or otherwise curvilinear path about a portion of the interior circumference of the docking station 60. In some embodiments, the orienting track 110 may be used in cooperation with the orienting edge 112. The orienting edge 112 also may be positioned for interaction with orienting fin 106 to, for example, rotate and then hold the motor connector 54 at the desired angular position during insertion of the motor connector 54 into the corresponding docking station 60. This allows the electrical connectors 76 to be linearly inserted into corresponding electrical wet connectors 88. As with the embodiment described above with reference to FIGS. 4-6, the fluid flow passages 90, 102 as well as the electrical connectors 76 and corresponding electrical wet connectors 88 may be located at off-axis positions, e.g. eccentric positions. The orientation features 92, 94 enable proper alignment and engagement of the electrical connectors 76 and corresponding electrical wet connectors 88 even when located at the eccentric positions.

Figure 11:
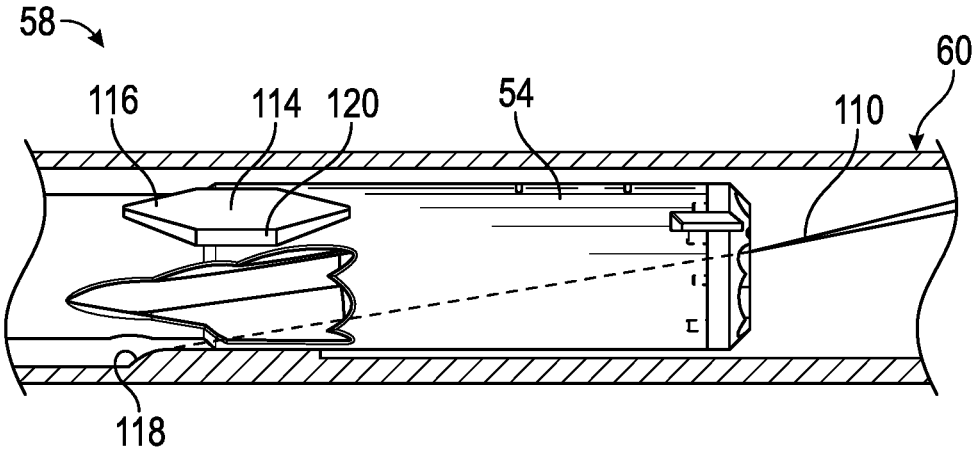
FIG. 11 is a schematic illustration of a docking assembly utilizing at least one centralizer to help centralize the motor connector of the submersible pumping system as the submersible pumping system is moved into the docking assembly, according to an embodiment of the disclosure.

Referring generally to FIG. 11, an embodiment is illustrated in which a centralizer or centralizers 114 are used to centralize the motor connector 54 during insertion into docking assembly 58. According to an embodiment, the interior of docking assembly 58 may include a plurality of centralizers 114 positioned to interact with motor connector 54 to centrally position the motor connector 54 within the docking assembly 58. In some embodiments, the centralizers 114 may be constructed and positioned to induce rotation of the motor connector 54 about its longitudinal axis to facilitate rotational alignment of the electrical connectors 76 with the corresponding electrical wet connectors 88.

In some embodiments, an upper portion 116 of each centralizer 114 extends gradually inward from an interior surface 118 of the docking assembly 58, e.g. from the interior surface of the docking station 60. In this manner, the centralizers 114 are able to guide the motor connector 54 without providing an abrupt leading edge that could otherwise impede descent of the motor connector 54 into the docking station 60. A main thickness 120 of each centralizer 114 may be sufficient to centralize the motor connector 54 within the interior region 86 of the docking station 60 and to aid in alignment of the motor connector 54 for proper connection between the electrical connectors 76 and the corresponding electrical wet connectors 88.

According to an embodiment, at least one centralizer 114, e.g. a plurality of centralizers 114, may operate in conjunction with the orienting track 110 and/or orienting edge 112 to both centralize and orient the motor connector 54 with respect to the docking station 60. According to an example, an uppermost edge of the orienting track 110 gradually extends from the interior surface 118 of docking station 60 without providing an abrupt edge that could otherwise impede the dissent of the motor connector 54 into the docking station 60. The centralizers 114 may be constructed in a variety of shapes, including hexagonal shapes, triangular shapes, reuleaux triangular shapes, or other suitable shapes.

The docking assembly 58 may be used with a variety of submersible pumping systems 20 to make electrical power available without routing a dedicated power cable with the submersible pumping system. The components of docking assembly 58 may be selected according to the parameters of a given operation and/or environment. For example, various types of electrical wet connectors, junction boxes, tubular structures, orientation features, and/or other components may be selected to properly position and engage the submersible pumping system while providing electrical power thereto. Similarly, the submersible pumping system 20 may utilize various types of motor connectors and corresponding electrical connectors for engagement with the docking station 60 of the overall docking assembly 58. Similarly, various types of power cables including at least one individual conductor, e.g. three individual conductors, may be used to provide power to the docking station 60.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

an electric submersible pumping system comprising a submersible motor, a submersible pump powered by the submersible motor, a motor protector, and a motor connector having a plurality of electrical connectors;

a docking assembly deployed downhole in a borehole, the docking assembly comprising a docking station having a plurality of electrical wet connectors and a fluid flow passage, the docking assembly further comprising a receiving tubular coupled to the docking station and sized to receive the electric submersible pumping system to enable coupling of the plurality of electrical connectors with the plurality of electrical wet connectors; and a power cable coupled to the docking station to provide electrical power to the plurality of electrical wet connectors.

2. The system as recited in claim 1, wherein the electrical power cable is coupled to the docking station through a junction box and comprises individual conductors coupled to the plurality of wet connectors.

3. The system as recited in claim 1, wherein the docking station comprises an orientation feature to rotationally orient the motor connector as it is moved into the docking station.

4. The system as recited in claim 3, wherein the orientation feature comprises an orienting edge positioned to engage a corresponding feature on the electric submersible pumping system and to rotate the electric submersible pumping system to a desired rotational position as the electric submersible pumping system is moved into the docking assembly.

5. The system as recited in claim 1, wherein the docking assembly further comprises a docking station seal assembly positioned form a seal with a surrounding tubular.

6. The system as recited in claim 1, wherein the docking assembly further comprises an intake positioned to allow well fluid to flow from the borehole to an interior of the docking assembly.

7. The system as recited in claim 6, wherein the docking assembly further comprises a valve disposed between the intake and the docking station.

8. The system as recited in claim 1, wherein the electric submersible pumping system further comprises a pumping system seal assembly positioned to seal against an inside surface of the receiving tubular when the electric submersible pumping system is moved into the docking assembly.

9. The system as recited in claim 1, wherein the plurality of electrical connectors and the plurality of electrical wet connectors are eccentrically located with respect to a central longitudinal axis.

10. The system as recited in claim 1, wherein the plurality of electrical connectors comprises three electrical connectors and the plurality of electrical wet connectors comprises three electrical wet connectors to enable three-phase power to be supplied to the submersible motor.

11. A system for supplying electrical power to an electric submersible pumping system located in a well, comprising:

a docking assembly deployed downhole in a borehole, the docking assembly comprising:

a receiving tubular;

a docking station disposed at a lower end of the receiving tubular, the docking station comprising at least one electrical wet connector disposed within an interior of the docking station so as to facilitate electrical connection with the electric submersible pumping system; and an electrical cable comprising at least one conductor, the electrical cable being at least partially disposed along an exterior surface of the receiving tubular, the electrical cable entering the docking station within which the at least one conductor is coupled in electrical communication with the at least one electrical wet connector.

12. The system as recited in claim 11, wherein the at least one electrical wet connector comprises a plurality of electrical wet connectors eccentrically located with respect to a central longitudinal axis of the docking station.

13. The system as recited in claim 11, wherein the docking station comprises an orientation tab disposed within the docking station.

14. The system as recited in claim 11, wherein the docking assembly comprises an orienting track disposed at a non-oblique angle relative to a longitudinal axis of the receiving tubular.

15. The system as recited in claim 11, wherein the docking station comprises an orienting edge disposed along an interior of the docking station.

16. The system as recited in claim 11, wherein the receiving tubular comprises a centralizer for centralizing the electric submersible pumping system within the docking assembly.

17. A method, comprising:

providing a docking station with a plurality of electrical wet connectors;

coupling the docking station to a receiving tubular to form a docking assembly;

connecting a power cable to the docking station to enable electrical power to be provided to the plurality of electrical wet connectors;

deploying the docking assembly downhole into a borehole;

moving an electric submersible pumping system downhole into the borehole and into the receiving tubular for electrical connection with the plurality of electrical wet connectors; and while moving the electric submersible pumping system downhole, rotationally orienting the electric submersible pumping system with respect to the docking station via an orientation feature in the docking assembly, and centralizing the electric submersible pumping system with respect to the docking station via one or more centralizers in the docking station.

18. The method as recited in claim 17, wherein moving the electric submersible pumping system comprises electrically coupling a plurality of electrical connectors of a motor connector with the plurality of electrical wet connectors.

19. The method as recited in claim 18, wherein rotationally orienting the electric submersible pumping system comprises rotationally orienting the motor connector with respect to the docking station via the orientation feature in the docking assembly and a corresponding orientation feature on the motor connector.

* * * * *